US009938676B2

(12) United States Patent
Koo

(10) Patent No.: US 9,938,676 B2
(45) Date of Patent: Apr. 10, 2018

(54) BRIDGE EXPANSION JOINT

(71) Applicant: JINHYUNG Construction Co., Ltd., Gimpo (KR)

(72) Inventor: Ja Hwa Koo, Gwacheon-si (KR)

( * ) Notice: Subject to any disclaimer, the term of this patent is extended or adjusted under 35 U.S.C. 154(b) by 3 days.

(21) Appl. No.: 15/262,082

(22) Filed: Sep. 12, 2016

(65) Prior Publication Data

US 2017/0073910 A1 Mar. 16, 2017

(30) Foreign Application Priority Data

Sep. 15, 2015 (KR) ..... 10-2015-0130056

(51) Int. Cl.
*E01D 19/06* (2006.01)

(52) U.S. Cl.
CPC ..... *E01D 19/065* (2013.01); *E01D 19/06* (2013.01)

(58) Field of Classification Search
CPC ..... E01D 19/062; E01D 19/067; E01D 19/04; E01D 19/041; E01D 19/042; E01D 19/043; E01D 19/06; E01D 19/00; E04B 1/68; E01C 11/06; E01C 11/123; E01C 11/126; E01C 11/04; E01C 11/045; E01C 11/10; E01C 11/103; E01C 11/106; E01C 11/12; E01C 11/14; E01C 11/02
See application file for complete search history.

(56) References Cited

U.S. PATENT DOCUMENTS 2,084,100 A * 6/1937 McHugh ..... E01D 19/065 14/73
3,677,145 A * 7/1972 Wattiez ..... E01D 19/06 404/47
3,797,952 A * 3/1974 Pommerening ..... E01D 19/062 14/73.1
4,504,170 A * 3/1985 Schukolinski ..... E04B 1/6804 404/55
5,172,533 A * 12/1992 Face, Jr. ..... E01C 11/10 404/47

(Continued)

FOREIGN PATENT DOCUMENTS

JP 2005016098 A * 1/2005
JP 2007032057 A * 2/2007

(Continued)

OTHER PUBLICATIONS

English translation of 10-0921415.

*Primary Examiner* — Abigail A Risic

(74) *Attorney, Agent, or Firm* — Antonio Ha & U.S. Patent, LLC

(57) ABSTRACT

In a bridge expansion joint, a pair of lower plates is disposed between one bridge deck section and the other bridge deck section with leaving a predetermined interval. An upper plate is respectively disposed on an upper surface of the lower plate, in which the width of the upper plate in the horizontal direction is smaller than that of the lower plate. A load supporting means is disposed on the upper surface of the upper plate. The load supporting means comprises a pair of link members or a pair of finger members. A reinforced plate is disposed between the load supporting means and the lower plate, in which an inclined plane is respectively provided at both sides of the reinforced plate so that the reinforced plate has a narrow top and wide bottom-shaped section.

11 Claims, 12 Drawing Sheets

(56) References Cited

U.S. PATENT DOCUMENTS

| | | | | |
|---|---|---|---|---|
| 6,022,169 | A * | 2/2000 | Kim | E01D 19/062 14/73.1 |
| 6,460,214 | B1 * | 10/2002 | Chang | E01D 19/06 14/73.1 |
| 6,609,265 | B1 * | 8/2003 | Jee | E01D 19/06 14/73.1 |
| 2002/0138925 | A1 * | 10/2002 | Chang | E01D 19/06 14/73.1 |
| 2007/0044257 | A1 * | 3/2007 | Xu | E01D 19/06 14/73.1 |
| 2008/0196183 | A1 * | 8/2008 | Xu | E01D 19/06 14/73.1 |
| 2014/0242863 | A1 * | 8/2014 | Voet | E01C 11/10 442/59 |
| 2015/0337500 | A1 * | 11/2015 | Diamond | E01C 11/02 404/53 |

FOREIGN PATENT DOCUMENTS

| | | | | |
|---|---|---|---|---|
| KR | 10-0921415 | | 10/2009 | |
| WO | WO-2008016241 | A1 * | 2/2008 | E01D 19/06 |

* cited by examiner

BRIDGE EXPANSION JOINT

BACKGROUND OF THE INVENTION

1. Field of the Invention

The present invention is related to a bridge expulsion joint, and more particularly, to a bridge expansion joint for connecting upper plates of a bridge in such a way that it enables the upper plates of the bridge to stretch or to be contracted in order to counteract the contraction and expansion of the bridge accenting to the changes in temperature, which is capable of preventing the accumulation of foreign substances and of easily discharging them to the outside.

2. Description of the Prior Art

As is well known, the bridge expansion joint may be designed for sufficiently supporting an external load under the service limit state and the ultimate limit state and for obtaining a sufficient durability, a good surface-smoothness and a satisfactory water-tightness by meeting a fundamental requirement for the fatigue limit situation.

Generally, in the long bridge structure having a plurality of bridge piers, a bridge deck section may be divided into a number of parts along the longitudinal direction of the bridge structure in order to counteract the contraction and expansion of the bridge according to the changes in temperature. The bridge expansion joint may be installed between the divided parts of the bridge deck section.

For example, the bridge expansion joint installed between the bridge deck sections of the bridge is an attachment for the bridge and it can accommodate the behavior of the bridge when the bridge is contracted or stretches in accordance with the changes in temperature.

The bridge expansion joint according to the prior art as described above may include a finger block of which a plurality of fingers are installed in the manner of the double structure such as the sliding-cantilever type structure. Due to this structure, although water or foreign substances is flowed between the fingers, it will not be dropped below the bridge deck sections and thereby resulting in safe protection of the surrounding structures.

The bridge expansion joint having the finger block according to the prior art can move along the direction of a vehicle's travel on the roadway over a range of expansion and contraction thereof when an earthquake strikes. However, it cannot move along a horizontal direction that is perpendicular to the direction of a vehicle's travel.

Another drawback of this conventional bridge expansion is that any structure for allowing a road packaging to be successfully and smoothly performed may be relatively insufficient and thereby resulting in the occurrence of the great noise and the vibration. Consequently, there is a disadvantage that driving performance of the vehicle is likely to deteriorate.

A variety of endeavors for solving the above problems have been proposed. One approach is, the refraction-type expansion and contraction joint apparatus for a bridge has been proposed on Korean Patent No. 10-0921415 issued to JINHYUNG CONSTRUCTION Co., Ltd, on Oct. 6, 2009. This joint apparatus of which a pair of link members is disposed between the bridge deck sections with opposite each other can move along the X-axis direction or the Y-axis direction in accordance with the behavior of the bridge. One drawback of this conventional apparatus is that the expansion and contraction to be embodied by means of the link members may be limited within a predetermined range. Accordingly, it is difficult to adopt this joint apparatus for any extremely long length of bridge.

Nevertheless, if the conventional joint apparatus is manufactured in such a way that the length of link members is relatively increased so as to be used for the long span bridge, then the bridge may be sagging or drooping at a middle portion of the link member or at the hinge engagement section due to the increase of the link member's weight. As a result, the link member cannot smoothly rotate. Because any technology for previously preventing the phenomenon of sagging or drooping has not been developed yet, it would seem likely that the above joint apparatus cannot be smoothly applied to the long span bridge.

Because the conventional joint apparatus of which the link members are fixed by only using the hinge does not have any means for reinforcing the combining state of the hinge, it is difficult to reliably maintain the hinge engagement.

In the meantime, the conventional joint apparatus is provided with the means for preventing foreign substances from being introduced, which may be made of flexible materials and ma be installed between the side plates disposed at the lower portions of the links in such a manner that it makes them to be connected each other.

There is high probability of this joint apparatus being received the repetitive load generated when the expansion and the contraction is repeatedly occurred in accordance with the behavior of the bridge deck section. Because foreign substances that have already been introduced will solidify over time, it would seem likely that the above joint apparatus cannot perform the proper function thereof and may even be destroyed in severe cases. Furthermore, it would seem likely that the rotational operation of the link may be hindered by foreign substances. Consequently, there are problems that the maintenance control is needed when things go wrong or break downs occur and also it is required to frequently replace the components of the joint apparatus.

Meanwhile, the links of the conventional joint apparatus can rotate with each other due to the operation of the hinge bolt. However, because water can enter certain apertures provided around the hinge bolt in the conventional joint apparatus, it would seem likely that it is impossible to prevent the water leak beforehand.

SUMMARY OF THE INVENTION

Accordingly, the present invention has been made with a view to overcoming the foregoing problems of the prior art. An object of the invention is to a bridge expansion joint capable of prevent foreign substances from penetrating by gravity and thereby resulting in reduction or prevention of foreign substances' accumulation, by installing a reinforced plate below a load supporting mean comprising a link member or a finger member, which is easily discharging foreign substances accumulated between the links or fingers in accordance with the behavior of the bridge deck sections.

In order to achieve the object as described above, the present invention provides a bridge expansion joint comprising:

- a pair of lower plates being disposed between one bridge deck section and the other bridge deck section with leaving a predetermined interval;
- an upper plate being respectively disposed on an upper surface of the lower plate, in which the width of the upper plate in the horizontal direction is smaller than that of the lower plate;

a load supporting means being disposed on the upper surface of the upper plate, the load supporting means comprising a pair of link members or a pair of finger members; and a reinforced plate being disposed between the load supporting means and the lower plate, in which an inclined plane is respectively provided at both sides of the reinforced plate so that the reinforced plate has a narrow top and wide bottom-shaped section;

wherein a storage space is defined by a lower surface of the load supporting means, the upper surface of the lower plate, the inclined plane of the reinforced plate, and the side surface of the upper plate; and wherein a plurality of penetration-prevention grooves are formed at the lower surface of the reinforced plate in such a manner that they extend along the longitudinal direction of the reinforced plate and they are spaced equally with each other along the width direction of the reinforced plate so as to restrain the flow of infiltrating water through a gap provided between the lower surface of the reinforced plate and the upper surface of the lower plate.

The pair of finger members are detachably attached to the upper plates by a bolt, respectively in such a manner that they cover the space created between the bridge deck sections, in which the finger members have a plurality of lingers that intersect with one another within the space, in which the reinforced plate is disposed between the lower surface of the finger and the upper surface of the lower plate.

The link member comprises a pair of link supporting members being respectively attached to the upper surface of the upper plate and they having a plurality of recesses formed at a side strike thereof so as to allow they move in the X-axis direction and the Y-axis direction in response to the behavior of the bridge; and a pair of links being respectively rotatably engaged at a first hinge part of the upper plate through a fixing end thereof in which the first hinge part of the upper plate is provided with corresponding to the recess of the link supporting member, in which the free end of one link is rotatably engaged with the free end of the other link and whereby the links can rotate about each other on a second hinge part; wherein the reinforced plate is disposed between a lower surface of the link and the upper suffice of the lower plate, and the central portion of the reinforce plate is connected to the second hinge part in such a manner that it is suspended there from.

The bridge expansion joint further comprises side plates extending vertically downwards from a lower surface of the lower plate. The side plates are disposed opposite each other at a position adjacent to the free end of the lower plate with making a pair so as to leave a predetermined interval in the horizontal direction.

The lower plate includes a drain passage disposed at the edge of the inner side surface of the lower plate in a space provided between the lower plates, in which the drain passage is fluid-communicated with a drain line installed in the bridge so that infiltrating water dropping from the penetration-prevention grooves of the reinforced plate may be received in the drain passage and thereafter it can flow toward the drain line.

The drain passage has a predetermined width that is equal to or greater than the distance between the penetration-prevention grooves.

The drain passage comprises a connecting plate covering a part of the upper surface of the lower plate; a first passage wall being rounded with right angles at a distal end of the connecting plate so that it encloses the inner side surface of the lower plate; a second passage wall extending parallel with the first passage wall and it being spaced from the first passage wall; and a bottom plate for connecting lower ends of the first and the second passage walls.

The link supporting member is provided with an arc-shaped supporting groove at a side surface of the recess, in which the arc-shaped supporting groove has function to snugly receive a supporting protrusion integrally extending from a side surface of one distal end of the links in such a manner that the supporting protrusion can smoothly rotate within the supporting groove.

The first hinge part comprises a first sliding bush for reducing the rotational frictional force of the link, the first sliding bush being inserted into a first hinge hole formed through one end of the link; a first hinge bolt being inserted into a first engaging hole formed through the upper plate and a second engaging hole formed through the lower plate, in which the first and the second engaging holes are formed to vertically correspond with the first hinge hole below the recess, in which a lower distal end of the first hinge bolt protrudes to the outside from the second engaging hole of the lower plate; a first nut being threadedly engaged with the exposed distal end of the first hinge bolt; and a first sliding pad having a ring shape and being installed within a first move formed a position adjacent to the first engaging hole at the upper plate so that the first sliding pad can be contacted with the lower surface of the first sliding bush and the lower surface of the link.

The height of an upper end of a first link in the second hinge part would amount to ½ of a thickness of the first link, in which the upper end of the first link is piled on a lower end of a second link, whereby the sum of the height of the upper end of the first link, the height of the lower end of the second link, and a gap between a lower surface of the upper end of the first link and an upper surface of the lower end of the second link would amount to the total thickness of the first link.

The second hinge part comprises a second sliding bush being inserted into a second hinge hole formed through the upper end of the first link and the lower end of the second link; a second hinge bolt being inserted into a fifth engaging hole formed through the reinforced plate, in which the fifth engaging hole is formed to vertically correspond with the second hinge hole, in which a lower distal end of the second hinge bolt protrudes to the outside from the fifth engaging hole of the reinforced plate; a second nut being threadedly engaged with the exposed lower distal end of the second hinge bolt; a sealing member being disposed between a lower surface of the reinforced plate and an inner surface of the second nut, the sealing member being pressurized by the second nut toward the lower surface of the reinforced plate; a second sliding pad being installed in a second groove formed at a position above the filth engaging hole of the reinforced plate so that it is contacted with lower surfaces of the second sliding bush and the lower end of the link; and a third sliding pad being installed in a third groove formed at a position above a fourth engaging hole of the lower end of the second link so that it is contacted with the lower surface of the upper end of the first link.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION OF THE EXEMPLARY EMBODIMENTS

Figure 1:
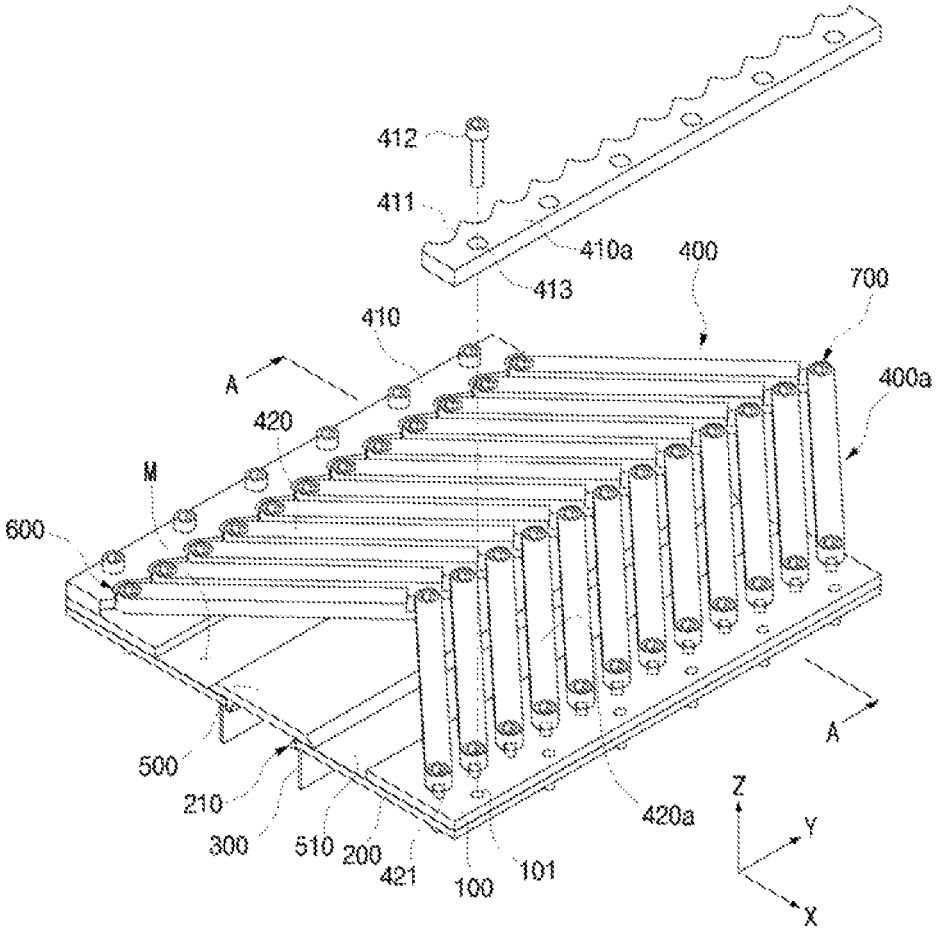
FIG. 1 is a perspective view of a bridge expansion joint according to a preferred first embodiment of the present invention, for showing the state in which one link supporting member is separated from an upper plate, for the sake of clarity.

The drawings in the present application and their accompanying detailed description are directed to merely example embodiments of the invention. The advantages and other features of the instruments and methods disclosed herein will become more readily apparent to those having ordinary skill in the art from the following detailed description of certain preferred embodiments taken in conjunction with the drawings which set forth representative embodiment of the present invention. It should be borne in mind that, unless noted otherwise, like or corresponding elements among the figures may be indicated by like or corresponding reference numerals.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

All relative descriptions herein such as left, right up, and down are with reference to the Figures, and not meant in a limiting sense. The illustrated embodiments can be understood as providing exemplary features of varying detail of certain embodiments, and therefore, features, components, modules, elements, and/or aspects of the illustrations can be otherwise combined, interconnected, sequenced, separated, interchanged, positioned, and/or rearranged without materially departing from the disclose systems or methods. The shapes and sizes of components are also exemplary and unless otherwise specified, can be altered without materially affecting or limiting the disclosed technology.

Hereinafter, the bridge expansion joint in accordance with preferred embodiments according to the present invention will be explained in detail.

Figure 2:
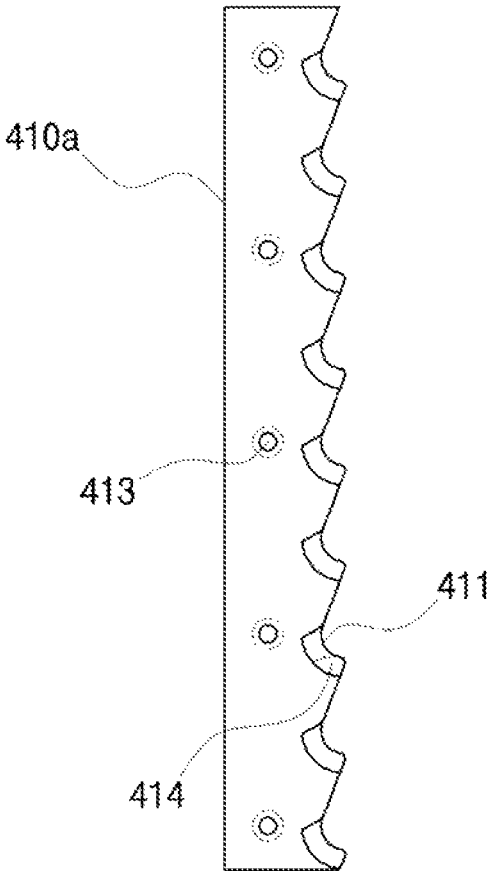
FIG. 2 is a bottom view of the link supporting member as shown in FIG. 1.

FIG. 1 is a perspective view of a bridge expulsion joint according to a preferred first embodiment of the present invention, for showing the state in which one link supporting member is separated from an upper plate, for the sake of clarity; FIG. 2 is a bottom view of the link supporting member as shown in FIG. 1; and FIG. 3 is an enlarged sectional view of the bridge expansion joint taken along time A-A shown in FIG. 1, for showing the state in which both link supporting members are mounted onto the upper plate.

Figure 3:
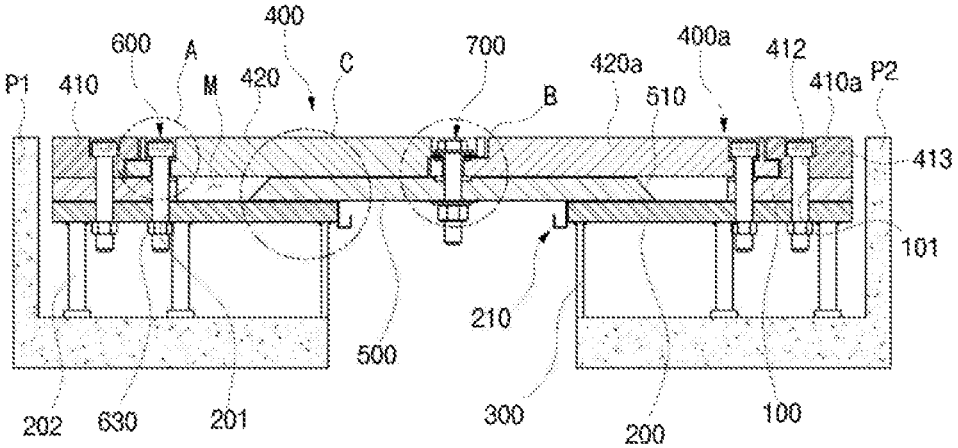
FIG. 3 is an enlarged sectional view taken along line A-A shown in FIG. 1, for showing the state in which both link supporting members are mounted onto the upper plate.

Referring to FIGS. 1 to 3, the bridge expansion joint according to the preferred first embodiment of the present invention comprises a pair of upper plates (100), a pair of lower plates (200), a pair of side plates (300), a pair of link members (400,400*a*) and a reinforced plate (500).

The pair of lower plates (200) are disposed between one bridge deck section (P1) and the other bridge deck section (P2) with leaving a predetermined interval, which are respectively corresponding with the bridge deck sections (P1, P2).

The upper plate (100) is respectively disposed on an upper surface of the lower plates (200) between one bridge deck section (P1) and the other bridge deck section (P2) with leaving a predetermined interval. At this time, the width of the upper plate (100) in horizontal direction is smaller than that of the lower plate (200). Outer side surfaces of the lower plate (200) and the upper plate (100) are line up in the vertical direction.

The reinforced plate (500) is also disposed on the upper surface of the lower plates (200). The reinforced plate (500) is disposed in such a manner that it cross the space created between the lower plates (200) and both side edge portions of a lower surface of the reinforced plate (500) are located on and sufficiently supported by the upper surface of the lower plates (200). At this time, the reinforced plate (500) is apart from the upper plate (100) at as predetermined distance on the upper surface of the lower plate (200). The height of the reinforced plate (500) is the same as that of the upper plate (100).

An inclined plane (510) is respectively provided at both sides of the reinforced plate (500) and it can play a role as a kind of blade or a cutting edge for cutting off, scraping, or breaking the accumulated foreign substances in the lateral direction.

Meanwhile, a part of the constitutional elements of the link members (400, 400*a*) that is, a pair of link supporting members (410, 410*a*) and a part of a pair of links (420, 420*a*) are disposed on the upper surfaces of the upper plates (100). In other words, as best seen in the left side of FIG. 3, the link supporting member (410) and a part of the link (420) are disposed on the upper surface of one upper plate (100). Likewise, as best seen in the right side of FIG. 3, the link supporting member (410*a*) and a part of the link (420*a*) are disposed on the upper surface of the other upper plate (100). The rest of the links (420,420*a*) are disposed on the upper surface of the reinforced plate (500). At this time, a storage space (M) is defined by the lower strikes of the links (420,420*a*), the upper surface of the lower plate (200), the inclined plane (510) of the reinforced plate (500), and the side surface of the upper plate (100).

The link members (400,400*a*) can function as a load supporting means. As described above, the link members (400, 400*a*) comprise the pair of link supporting members (410, 410*a*) and the pair of links (420, 420*a*). The link members (400, 400*a*) can move along the X-axis direction and the Y-axis direction in response to the behavior of the bridge, that is the behavior of the one bridge deck section (P1) at one side of the bridge and the other bridge deck section (P2) at the other side of the bridge. The upper surfaces of the link members (400,400*a*) may be contacted with wheels of the vehicle while a vehicle travels on the roadway. The link members (400,400*a*) are supported by the reinforce plate (500), the upper plate (10) and the lower plate (200), which are laminated together.

The lower plate (200) is provided with a drain passage (210) at its inner side surface. This drain passage (210) is fluid-communicated with a drain line (not shown in the drawings) already installed in the bridge so as to make infiltrating water to be flowed. The drain passages (210) are disposed on the inner side surface of the lower plate (200) with making a pair so as to leave a predetermined interval in the horizontal direction.

The side plate (300) extends vertically downwards from a lower surface of the free end of the tower plate (200). Consequently, two side plates (300) are disposed opposite each other at the lower surface of the lower plate (200) with making a pair so as to leave a predetermined interval in the horizontal direction.

Figure 4:
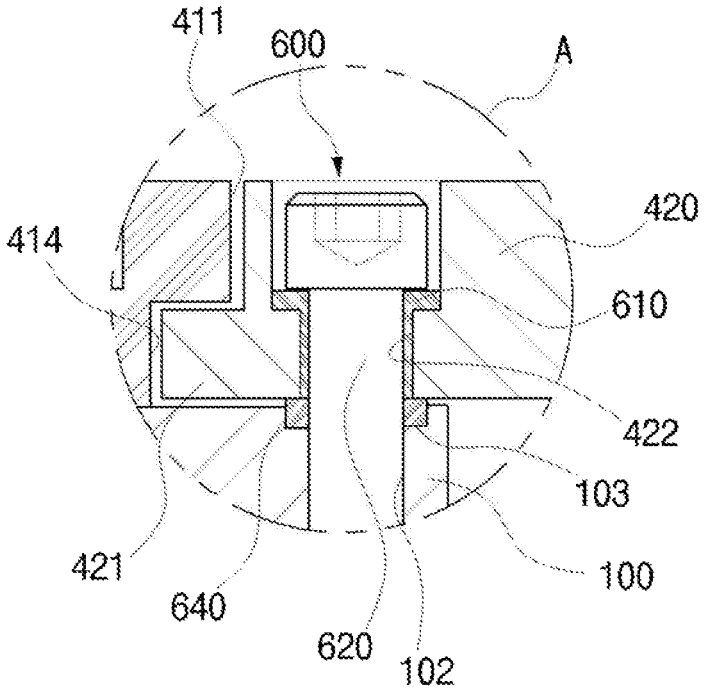
FIG. 4 is an enlarged sectional view of the circle "A" as shown in FIG. 3.

The link supporting members (410,410*a*) are respectively attached to the upper surface of the upper plate (100) and they have a plurality of arc-shaped recesses (411) formed at a side surface thereof, respectively as best seen in FIG. 4.

The link supporting members (410,410*a*) and the upper plates (100) are detachably assembled together by inserting a plurality of bolts (412) into a first through hole (413) formed through the link supporting members (410,410*a*), a second through hole (101) formed through the upper plate (100) and a third through hole (reference numeral is omitted).

The links (420, 420*a*) are provided with corresponding to the number of the recess (411) and they are disposed along the longitudinal direction of the link supporting members (410,410*a*) in such a manner that it is possible to maintain a predetermined interval there between with corresponding to the gap between the recesses (411). The pair of links (420, 420*a*) are respectively rotatably engaged at a first hinge part (600) of the upper plate (100) through a fixing end thereof in which the first hinge part (600) of the upper plate (100) is provided with corresponding to the recess (411) of the link supporting member (410, 410*a*). The free end of one link (420) is rotatably engaged with the free end of the other link (420*a*), and whereby the link (420, 420*a*) can rotate about each other on a second hinge part (700).

The first hinge part (600) and the second hinge part (700) are constructed in such a manner to prevent foreign substances from being introduced in advance and to reduce the noise and to rotate in a smoothly. The constitutional elements of them will be explained in detail below.

Meanwhile, the reinforced plate (500) is disposed between the lower surfaces of the links (420, 420*a*) and the upper surfaces of the lower plates (200) along the direction of X-axis. The central portion of the reinforce plate (500) is connected to the second hinge part (700) in such a manner that it is suspended there from. Because the reinforce plate (500) is provided with the inclined planes (510) formed at edges of both sides thereof, it has a narrow top and wide bottom-shaped section. The reinforced plate (500) and the inclined planes (510) can function to prevent foreign substances from being accumulated and to smoothly discharge foreign substances.

Referring to FIG. 2, the link supporting member (410*a*) is provided with an arc-shaped supporting groove (414) at a side surface of the recess (411). At this time, the arc-shaped supporting groove (414) means a dented site provided at the side surface of the recess (411).

Referring to FIGS. 1 and 2, the arc-shaped supporting groove (414) has function to snugly receive a supporting protrusion (421) (as well be seen in FIG. 4) integrally extending from a side surface of one distal end of the links (420, 420*a*) in such as manner that the supporting protrusion (421) can smoothly rotate within the supporting groove (414).

When the links (420, 420*a*) rotate on the first hinge part (600) with maintaining horizontal stability, the pivotal movement of the links (420, 420*a*) is supported by means of the supporting protrusion (421). Likewise, when the links (420, 420*a*) expand or contract within the limits of its operation by receiving external shock or external force occurred while a vehicle travels on the roadway, the pivotal movement of the links (420, 420*a*) is supported by means of the supporting protrusion (421). Because the external shock or the external force is dispersed toward the link supporting members (410, 410*a*), the links (420, 420*a*) can have a powerful durability and thereby resulting in the reliable rotation of the links (420,420*a*) on the first hinge part (600).

Meanwhile, a plurality of anchors (202) downwardly extend front the lower surface of the lower plate (200) and they may be connected to a variety of main steel bars or reinforcing steel bars already installed in the bridge deck sections (P1, P2). Then, they will be embedded in the bridge deck sections (P1, P2) when pouring concrete in the future.

The first through hole (413) formed through the link supporting members (410, 410*a*) as described above, a first hinge hole (422) (it can be referred to FIG. 4) formed at the first hinge part (600) and a second hinge hole (427) (it can be referred to FIG. 5) of the second hinge part (700) may be formed as a shape of countersunk head hole at parts of them, respectively so that a head of the bolt to be inserted there through will not be exposed to the outside.

FIG. 4 is an enlarged sectional view of the circle "A" as shown in FIG. 3.

Referring to FIGS. 3 and 4, the first hinge part (600) includes a first sliding bush (610) for reducing the rotational frictional force of the link (420), which is inserted into the first hinge hole (422) formed through one end of the link (420). The first sliding bush (610) can function as a sliding bearing or a solid bearing. The first sliding bush (610) has a substantially cylindrical shape. A flange is formed at an upper portion of the cylindrical shaped-body of the first sliding bush (610) so that a lower surface of the head of a first hinge bolt (620) can be safely supported by the flange.

The first hinge part (600) further comprises a first hinge bolt (620) inserted into the first sliding bush (610). In detail, the first hinge bolt (620) is inserted into a first engaging hole (102) formed through the upper plate (100) and a second engaging hole (201) formed through the lower plate (200), in which the first and the second engaging holes (102, 201) are formed to vertically correspond with the first hinge hole (422) below the recess (411), in which a lower distal end of the first hinge bolt (620) protrudes to the outside from the second engaging hole (201) of the lower plate (200).

The first hinge part (600) further includes a first nut (630) threadedly engaged with the exposed distal end of the first hinge bolt (620); and a first sliding pad (640), which has a ring shape and is installed within a first groove (103) formed a position adjacent to the first engaging hole (102) at the upper plate (100) so that the first sliding pad (640) can be contacted with the lower surface of the first sliding bush (610) and the lower surface of the link (420). The first sliding pad (640) can function to previously prevent foreign substances from being introduced in advance and to rotate in a smoothly along with reducing noise.

Figure 5:
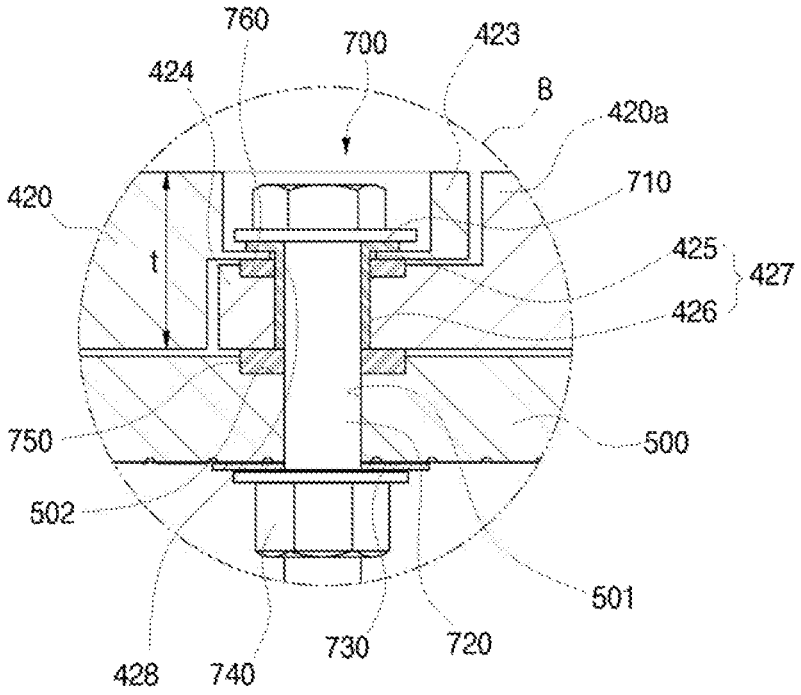
FIG. 5 is an enlarged sectional view of the circle "B" as shown in FIG. 3.

FIG. 5 is an enlarged sectional view of the "B" as shown in FIG. 3.

Referring to FIG. 3 or 5, the sum of the height of an upper end (423) of the link (420*a*) and a gap between a lower surface of the upper end (423) and the upper surface of the link (420*a*) in the second hinge part (700) would amount to ½ of the link thickness (t).

The upper end (423) of the link (420*a*) is piled on a lower end (424) of the link (420*a*) so that the upper end (423) and the lower end (424) overlapped together. Consequently, the sum of the height of the upper end (423), the gap between the lower surface of the upper end (423) and the upper surface of the link (420*a*) in the second hinge part (700), and the height of the lower end (424) would amount to the thickness (t) of the other link (420).

A second hinge hole (427) is formed through the upper end (423) and the lower end (424) overlapped together. At this time the second hinge hole (427) can be divided into a third engaging hole (425) formed through the upper end (423) and a fourth engaging hole (426) formed through the lower end (424).

The second hinge part (700) includes a second sliding bush (710) inserted into the second hinge hole 427. The second sliding bush (710) can serve the same function as the first sliding bush (610) and it is made of the same material as the first sliding bush (610). The second sliding bush (710) has a substantially cylindrical shape. A flange is formed at an upper portion of the cylindrical shaped-body of the second sliding bush (710) so that a lower surface of the head of a second hinge bolt (720) can be safely supported by the flange.

The second hinge part (700) further comprises a second hinge bolt (720) inserted into the second sliding bush (710). In detail, the second hinge bolt (720) is inserted into a fifth engaging hole (501) formed through the reinforced plate (500), in which the fifth engaging hole (501) is formed to vertically correspond with the second hinge hole (427), in which a lower distal end of the second hinge bolt (720) protrudes to the outside from the fifth engaging hole (501) of the reinforced plate (500). A second nut (740) is threadedly engaged with the exposed lower distal end of the second hinge bolt (720).

A sealing member (730) is disposed between a lower surface of the reinforced plate (500) and an inner surface of the second nut (740). The second nut (740) pressurizes the sealing member (730) toward the lower surface of the reinforced plate (500). Because the sealing member (730) is installed at the lower surface of the reinforced plate (500) in the second hinge part (700), it is possible to prevent the flow of infiltrating water and thereby resulting in the protection of leak.

The second hinge part (700) further includes a second sliding pad (750) and a third sliding pad (760). The second sliding pad (750) is installed in a second groove (502) formed at a position above the filth engaging hole (501) of the reinforced plate (500) so that it is contacted with a lower surface of the second sliding bush (710) and the lower end (424) of the link (420*a*). Likewise, the third sliding pad (760) is installed in a third groove (428) formed at a position above the fourth engaging hole (426) of the lower end (424) of the link (420*a*) so that it is contacted with the lower surface of the upper end (423) of link (420). The second sliding pad (750) and the third sliding pad (760) can function to previously prevent foreign substances from being introduced in advance and to rotate in a smoothly of the links (420, 420*a*) along with reducing noise.

Figure 6:
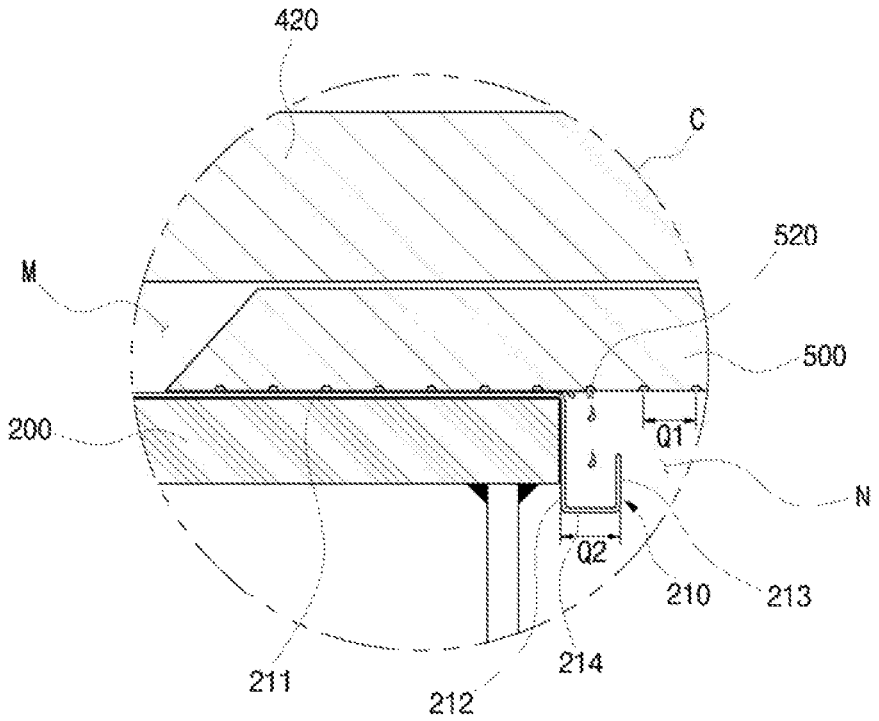
FIG. 6 is an enlarged sectional view of the circle "C" as shown in FIG. 3.

FIG. 6 is an enlarged sectional view of the circle "C" as shown in FIG. 3.

As shown in FIG. 6, because the reinforced plate (500) covers the space (N) created between the lower plates (200), foreign substances or infiltrating water do not drop toward a lower structure (not shown) of the embodiment according to the present invention. Only, foreign substances or infiltrating water may be introduced into the storage space (M) via the space between the upper surface of the reinforced plate (500) and the lower surface of the links (420). Foreign substances or infiltrating water which temporarily stay within the storage space (M) do not fall down toward the lower structure (not shown) and they may be discharged through the drain passage (210).

For this purpose, a plurality of penetration-prevention grooves (520) are formed at the lower surface of the reinforced plate (500) in such a manner that they extend along the longitudinal direction of the reinforced plate (500) (the width direction is the X-axis direction) and they are spaced equally with each other along the width direction of the reinforced plate (500). Due to the figural characteristic and the structural features of the penetration prevention grooves (520), infiltrating water may reach the penetration-prevention grooves (520) and then it has formed on the penetration-prevention grooves (520).

Although, infiltrating water can flow through the gap provided between the lower surface of the reinforced plate (500) and the upper surface of the lower plate (200), the flow of the infiltrating water may be restrained at the penetration-prevention grooves (520) after it passing through the gap or it may drops toward the drain passage (210).

The drain passage (210) is disposed at the edge of the inner side surface at the lower plate (200) in the space (N) provided between the lower plates (200). The drain passage (210) is fluid-communicated with a drain line installed in the bridge so that infiltrating water dropping from the penetration-prevention grooves (520) of the reinforced plate (500) may be received in the drain passage (210) and thereafter it can flow toward the drain line already installed in the bridge.

The drain passage (210) has a predetermined width (Q2) that is equal to or greater than the distance (Q1) between the penetration-prevention grooves (520).

The drain passage (210) comprises: a connecting plate (211) covering a part of the upper surface of the lower plate (200); a first passage wall (212) being rounded with right angles at a distal end of the connecting plate (211) so that it encloses the inner side surface of to the lower plate (200); a second passage wall (213) extending parallel with the first passage wall (211) and it being spaced from the first passage wall (211); and a bottom plate (214) for connecting lower ends of the first and the second passage walls (212, 213).

Herein below, operating procedures of the bridge joint apparatus according to the preferred first embodiment of the present invention will be explained in detail.

Figure 7:
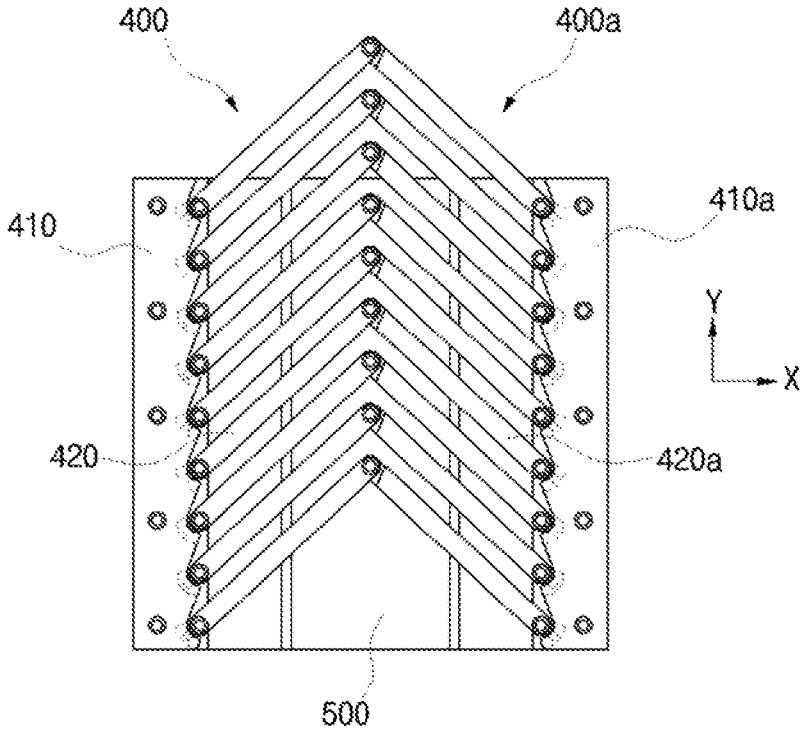
FIGS. 7 and 8 are top views of the bridge expansion joint as shown in FIG. 1, for showing the operational state of the link.
Figure 8:
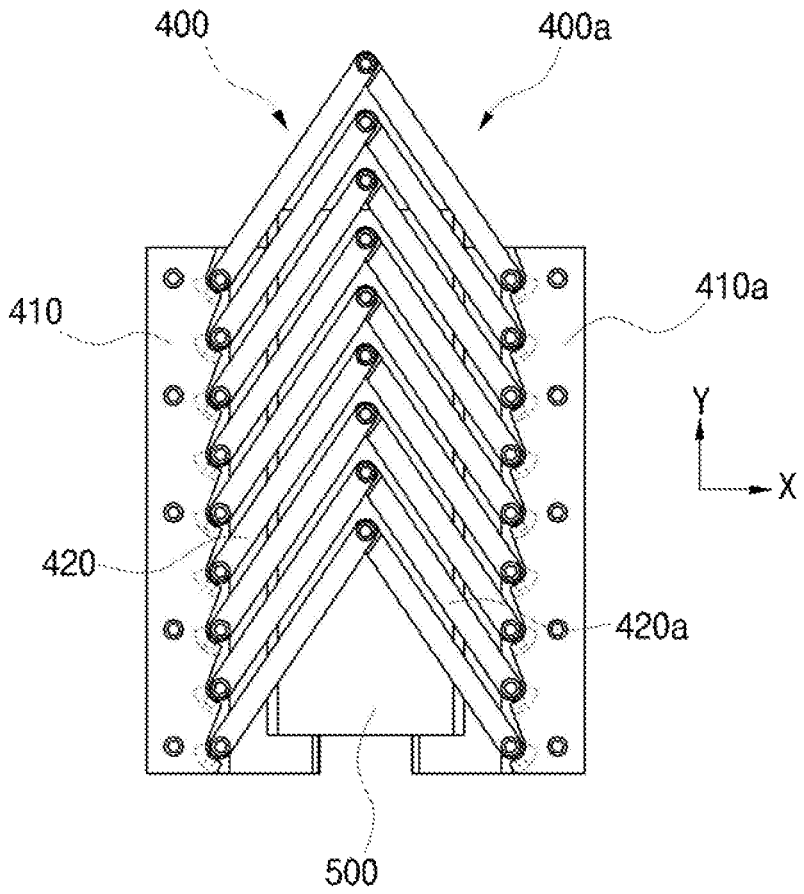

FIGS. 7 and 8 are top views of the bridge expansion joint as shown in FIG. 1, for showing the operational status of the link;

Referring to FIGS. 7 and 8, according to the present invention, the links (420, 420*a*) disposed between the link supporting members (410, 410*a*) may maintain a certain extent of folded state.

If as horizontal displacement or a certain behavior of the bridge is occurred or the distance between the bridge deck sections is decreased due to the change of temperature or the earthquake, the links (420, 420*a*) rotate on the fast hinge part (600) and the second hinge part (700) in order to effectively offset the behaviors along the directions of X-axis and Y-axis.

For example, the operational state of the links (420, 420*a*) can be changed from the relaxed condition as shown in FIG. 7 into the retracted condition as shown in FIG. 8. On the contrary, the operational state of the links (420, 420*a*) can be changed from the retracted condition as shown in FIG. 8 into the relaxed condition as shown in FIG. 7. Alternatively, the links (420, 420*a*) can be unfolded in a straight line from the relaxed condition as shown in FIG. 7.

At this time, the reinforced plate (500) can function to cover the space or the clearance of the bridge expansion joint during the movement of the links (420, 420*a*) so as to prevent foreign substances from being introduced or accumulated between the spaces or the clearances. Furthermore, the reinforced plate (500) can function to reinforce the connection between the links (420, 420*a*) and to discharge foreign substances accumulated between the links (420, 420*a*) to the outside in accordance with the behavior of the bridge deck sections.

Figure 9:
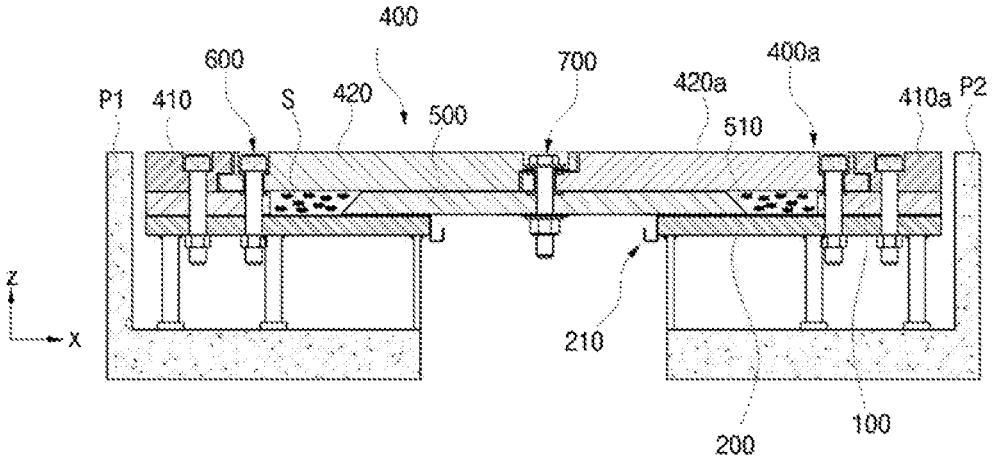
FIGS. 9 and 10 are sectional views of the bridge expansion joint as shown in FIG. 1, for showing the state in which foreign substances are discharged to the outside due to the operation of a reinforced plate.
Figure 10:
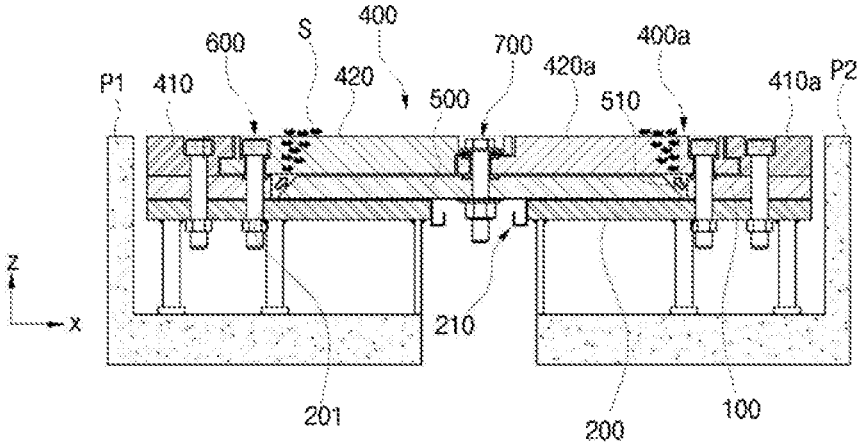

FIGS. 9 and 10 are sectional views of the bridge expansion joint as shown in FIG. 1, showing the state in which foreign substances are discharged to the outside due to the operation of the reinforced plate (500).

Referring to FIGS. 9 and 10, foreign substances (S) may be accumulated between the inner side surface of the upper plate (100) and the slanted side surface (510) of the reinforced plate (500) on the upper surface of the lower plate (200), after they passing through the space or the clearance between links (420, 420*a*).

If the operational state of the links (420, 420*a*) is changed from the relaxed condition as shown in FIG. 9 into the retracted condition as shown in FIG. 10 in accordance with the behavior of the bridge deck sections (P1, P2), then the link supporting members (410, 410*a*) move to closer with each other along the direction of X-axis. At this time, the reinforced plate (500) does not move along the direction of X-axis. That is, the reinforced plate (500) performs a relative motion to the link supporting member (410, 410*a*). Then, foreign substances may be pushed upwards along the slanted side surface (510) of the reinforced plate (500) while it performing the relative motion. As a result, foreign substances are forcibly discharged to the outside as illustrated in FIG. 10. Finally, foreign substances may be removed through the drain line of the bridge in such a manner that they are washed away by rain.

Figure 11:
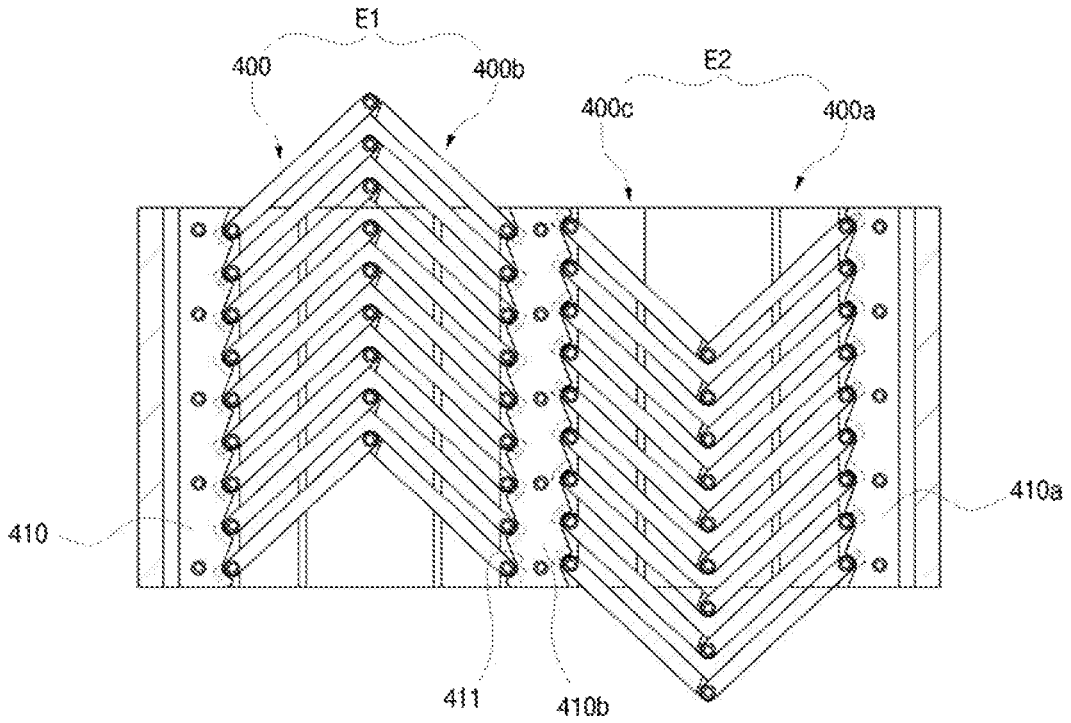
FIG. 11 is a top view of a bridge expansion joint to a preferred second embodiment of the present invention, for showing the state in which a group of link members are disposed onto the link supporting members.

FIG. 11 is a top view of a bridge expansion joint to a preferred second embodiment of the present invention, for showing the state in which a group of link members are disposed onto the link supporting members.

Referring to FIG. 11, the bridge expansion joint to the preferred second embodiment of the present invention is similar in many respects to the preferred first embodiment, except that two rows of link members (400 and 400*b*, 400*c* and 400*a*) denoted by "E1, E2" are installed between the link supporting members (410, 410*a*) and an inner supporting member (410*b*). Alternatively, instead of two rows of the link members (E1, E2), three or more link members can be added between the link supporting members (410, 410*a*) together with a plurality of inner supporting members and thereby resulting in the formulation of additional link connecting structures. The inner supporting member (410*b*) is provided with a plurality of recesses (411), which are formed opposite each other at both side surfaces thereof and are spaced with each other leaving a predetermined interval along the longitudinal direction thereof. The plurality of link members to be additionally installed according to the need can be disposed in a bilaterally symmetrical arrangement or in an asymmetry arrangement with respect to the inner supporting member (410*b*). The bridge expansion joint having two or more rows of link members can be flexibly applied to the long span bridge with providing a good durability.

Figure 12:
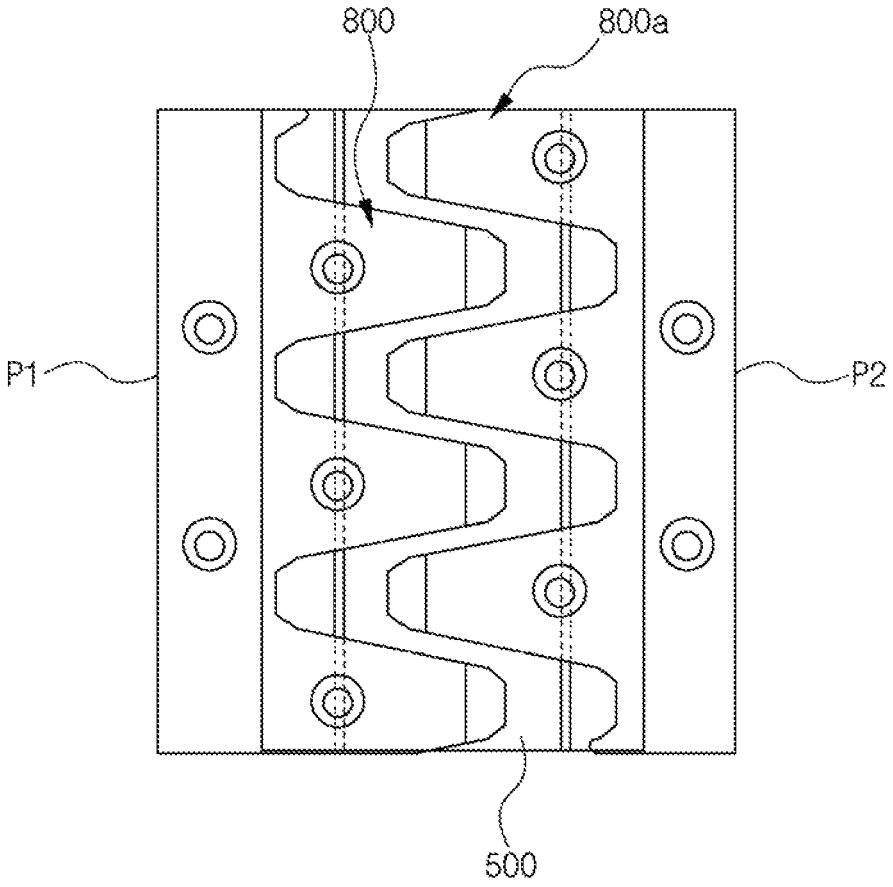
FIG. 12 is a top view of a bridge expansion joint to a preferred third embodiment of the present invention.

FIG. 12 is a top view of a bridge expansion joint to a preferred third embodiment of the present invention.

Referring to FIG. 12, a pair of finger members (800, 800*a*) can function as a load supporting means, which may be contacted with wheels of the vehicle while a vehicle travels on the roadway.

As described above with reference to FIGS. 3, 9 and 10, the upper plates or the lower plates according to the preferred third embodiment of the present invention are disposed between the bridge deck sections (P1, P2). The pair of finger members (800, 800*a*) is detachably attached to the upper plates by a bolt, respectively in such a manner that they cover the space created between the bridge deck section (P1, P2). They have a plurality of fingers that intersect with one another within the space. As described above, the reinforced plate (500) is disposed between the lower surface of the linger of the finger members (800, 800*a*) and the upper surface of the lower plate.

In order to dispose the reinforced plate (500) between the upper plates, a plurality of link members for securing the same interval or a connecting means (=not shown in the drawings) such as a flexible member may be additionally installed between the side plates. The lower surface of the reinforced plate (500) may be connected to a distal end of the upper portion of a supporter upwardly extending from the connecting means. As a result, no matter what the distance between the bridge deck section (P1, P2) is decreased or increased, the reinforced plate (500) can be located at the center of the storage space between the upper plates.

Since the reinforced plate (500) disposed below the finger members (800, 800*a*) performs a relative motion against the behavior of the bridge as described above with reference to FIG. 9 or FIG. 10, foreign substances accumulated between the finger members may be pushed upwards along the inclined plane (510) of the reinforced plate (500) while it performing the relative motion. As a result, foreign substances are forcibly discharged to the outside of the bridge expansion joint.

Although the invention is described with respect to specific embodiments, the principles of the invention, as defined by the claims appended herein, can obviously be applied beyond the specific embodiments of the invention described herein. The foregoing description of preferred embodiments of the present invention has been presented for the purposes of illustration and description. It is not intended to be exhaustive or to limit the invention to the precise form disclosed. Modifications and variations are possible in light of the above teachings, or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A bridge expansion joint comprising:

a pair of lower plates being disposed between one bridge deck section and the other bridge deck section and spaced apart from each other at a predetermined interval;

an upper plate being respectively disposed on an upper surface of the lower plate, in which the width of the upper plate in the horizontal direction is smaller than that of the lower plate;

a load supporting means being disposed on the upper surface of the upper plate, the load supporting means comprising a pair of link members or a pair of finger members; and a reinforced plate being disposed between the load supporting means and the lower plate, in which an inclined plane is respectively provided at both sides of the reinforced plate so that the reinforced plate has a narrow top and wide bottom-shaped section;

wherein a storage space is defined by a lower surface of the load supporting means, the upper surface of the lower plate, the inclined planes of the reinforced plate, and the side surface of the upper plate; and wherein a plurality of penetration-prevention grooves are formed at the lower surface of the reinforced plate in such a manner that they extend along the longitudinal direction of the reinforced plate and they are spaced equally with each other along the width direction of the reinforced plate so as to restrain the flow of infiltrating water through a gap provided between the lower surface of the reinforced plate and the upper surface of the lower plate.

2. The bridge expansion joint as claimed in claim 1, wherein the pair of finger members are detachably attached to the upper plates by a bolt, respectively in such a manner that they cover the space created between the bridge deck sections, in which the finger members have a plurality of fingers that intersect with one another within the space, in which the reinforced plate is disposed between the lower surface of the finger and the upper surface of the lower plate.

3. The bridge expansion joint as claimed in claim 1, wherein the link member comprises:

a pair of link supporting members being attached to the upper surface of the upper plate, respectively and they having a plurality of recesses formed at a side surface thereof so as to allow they move in the X-axis direction and the Y-axis direction in response to the behavior of the bridge; and a pair of links being respectively rotatably engaged at a first hinge part of the upper plate through a fixing end thereof in which the first hinge part of the upper plate is provided with corresponding to the recess of the link supporting member, in which the free end of one link is rotatably engaged with the free end of the other link and whereby the links can rotate about each other on a second hinge part;

wherein the reinforced plate is disposed between a lower surface of the link and the upper surface of the lower plate, and the central portion of the reinforce plate is connected to the second hinge part in such a manner that it is suspended there from.

4. The bridge expansion joint as claimed in claim 3, further comprising side plates extending vertically downwards from a lower surface of the lower plate, in which the side plates are disposed opposite each other at a position adjacent to the free end of the lower plate with making a pair so as to leave a predetermined interval in the horizontal direction.

5. The bridge expansion joint as claimed in claim 1, wherein the lower plate includes a drain passage disposed at the edge of the inner side surface of the lower plate in a space provided between the lower plates, in which the drain passage is fluid-communicated with a drain line installed in the bridge so that infiltrating water dropping from the penetration-prevention grooves of the reinforced plate may be received in the drain passage and thereafter it can flow toward the drain line.

6. The bridge expansion joint as claimed in claim 5, wherein the drain passage has a predetermined width that is equal to or greater than the distance between the penetration-prevention grooves.

7. The bridge expansion joint as claimed in claim 6, wherein the drain passage comprises:

a connecting plate covering a part of the upper surface of the lower plate;

a first passage wall being rounded with right angles at a distal end of the connecting plate so that it encloses the inner side surface of the lower plate;

a second passage wall extending parallel with the first passage wall and it being spaced from the first passage wall; and a bottom plate for connecting lower ends of the first and the second passage walls.

8. The bridge expansion joint as claimed in claim 3, wherein the link supporting member is provided with an arc-shaped supporting groove at a side surface of the recess, in which the arc-shaped supporting groove has function to snugly receive a supporting protrusion integrally extending from a side surface of one distal end of the links in such a manner that the supporting protrusion can smoothly rotate within the supporting groove.

9. The bridge expansion joint as claimed in claim 8, wherein the first hinge part comprises:

a first sliding bush for reducing the rotational frictional force of the link, the first sliding bush being inserted into a first hinge hole formed through one end of the link;

a first hinge bolt being inserted into a first engaging hole formed through the upper plate and a second engaging hole formed through the lower plate, in which the first and the second engaging holes are formed to vertically correspond with the first hinge hole below the recess, in which a lower distal end of the first hinge bolt protrudes to the outside from the second engaging hole of the lower plate;

a first nut being threadedly engaged with the exposed distal end of the first hinge bolt; and a first sliding pad having a ring shape and being installed within a first groove formed a position adjacent to the first engaging hole at the upper plate so that the first sliding pad can be contacted with the lower surface of the first sliding bush and the lower surface of the link.

10. The bridge expansion joint as claimed in claim 3, wherein the height of an upper end of a first link in the second hinge part would amount to ½ of a thickness of the first link, in which the upper end of the first link is piled on a lower end of a second link, whereby the sum of the height of the upper end of the first link, the height of the lower end of the second link, and a gap between a lower surface of the upper end of the first link and an upper surface of the lower end of the second link would amount to the total thickness of the first link.

11. The bridge expansion joint as claimed in claim 10, wherein the second hinge part comprises:

a second sliding bush being inserted into a second hinge hole formed through the upper end of the first link and the lower end of the second link;

a second hinge bolt being inserted into a fifth engaging hole formed through the reinforced plate, in which the fifth engaging hole is formed to vertically correspond with the second hinge hole, in which a lower distal end of the second hinge bolt protrudes to the outside from the fifth engaging hole of the reinforced plate;

a second nut being threadedly engaged with the exposed lower distal end of the second hinge bolt;

a sealing member being disposed between a lower surface of the reinforced plate and an inner surface of the second nut, the sealing member being pressurized by the second nut toward the lower surface of the reinforced plate;

a second sliding pad being installed in a second groove formed at a position above the fifth engaging hole of the reinforced plate so that it is contacted with lower surfaces of the second sliding bush and the lower end of the link; and a third sliding pad being installed in a third groove formed at a position above a fourth engaging hole of the lower end of the second link so that it is contacted with the lower surface of the upper end of the first link.

* * * * *